US011430380B2

(12) United States Patent
Lai et al.

(10) Patent No.: US 11,430,380 B2
(45) Date of Patent: Aug. 30, 2022

(54) PIXEL CIRCUIT AND PIXEL CIRCUIT DRIVING METHOD

(71) Applicant: AU Optronics Corporation, Hsin-Chu (TW)

(72) Inventors: Po-Chun Lai, Hsin-Chu (TW); Wei-Ting Wu, Hsin-Chu (TW); Wei-Jen Chen, Hsin-Chu (TW); Chi-Fu Tsao, Hsin-Chu (TW); Yung-Chih Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/368,309

(22) Filed: Jul. 6, 2021

(65) Prior Publication Data

US 2022/0020317 A1 Jan. 20, 2022

(30) Foreign Application Priority Data

Jul. 20, 2020 (TW) ..... 109124462

(51) Int. Cl.
*G09G 3/32* (2016.01)

(52) U.S. Cl.
CPC ..... *G09G 3/32* (2013.01); *G09G 2300/0819* (2013.01); *G09G 2300/0861* (2013.01)

(58) Field of Classification Search
CPC ..... G09G 3/32; G09G 2300/0819; G09G 2300/0861; G09G 3/3208; G09G 3/3275
See application file for complete search history.

(56) References Cited

U.S. PATENT DOCUMENTS

2007/0040772 A1* 2/2007 Kim ..... G09G 3/3233 345/76
2018/0374419 A1 12/2018 Chen et al.

FOREIGN PATENT DOCUMENTS

CN 110992886 A 4/2020
JP 2011158821 A 8/2011

* cited by examiner

*Primary Examiner* — Andrew Sasinowski
(74) *Attorney, Agent, or Firm* — WPAT, PC

(57) ABSTRACT

The present disclosure relates to a pixel circuit including a light emitting element, a driving circuit, a first data storage circuit and a second data storage circuit. The driving circuit is electrically coupled to the light emitting element. The first data storage circuit is electrically coupled to the driving circuit, and is configured to transmit a first data signal to the driving circuit during a first frame period, so that the driving circuit drives the light emitting element according to the first data signal. The second data storage circuit is electrically coupled to the driving circuit, and is configured to receive a second data signal during the first frame period.

17 Claims, 14 Drawing Sheets

PIXEL CIRCUIT AND PIXEL CIRCUIT DRIVING METHOD

CROSS-REFERENCE TO RELATED APPLICATION

This application claims priority to Taiwan Application Serial Number 109124462, filed Jul. 20, 2020, which is herein incorporated by reference in its entirety.

BACKGROUND

Technical Field

The present disclosure relates to a pixel circuit and pixel circuit driving method, especially a circuit for driving a lighting element according to a data signal.

Description of Related Art

With the rapid development of electronic technology, display device has been widely used in people's lives, such as smart phones or computers. The display device separately controls the brightness of each pixel on the display panel in different frames to present a corresponding image. The update method of the display device between multiple frames will affect its display quality.

SUMMARY

One aspect of the present disclosure is a pixel circuit, comprising a lighting element, a driving circuit, a first data storage circuit and a second data storage circuit. The driving circuit is electrically coupled to the lighting element. The first data storage circuit is electrically coupled to the driving circuit. The first data storage circuit is configured to transmit a first data signal to the driving circuit during a first frame period, and the driving circuit is configured to drive the lighting element according to the first data signal. The second data storage circuit is electrically coupled to the driving circuit. The second data storage circuit is configured to receive a second data signal during the first frame period.

Another aspect of the present disclosure is a pixel circuit driving method, comprising the following steps: receiving a first data signal from a first data storage circuit during a first frame period, and driving a lighting element according to the first data signal; receiving and storing a second data signal by a second data storage circuit during the first frame period; receiving the second data signal from the second data storage circuit during a second frame period, and driving the lighting element according to the second data signal; and receiving and storing a third data signal by a first data storage circuit during the second frame period.

Another aspect of the present disclosure is a pixel circuit, comprising a lighting element, a driving circuit, a first data storage circuit and a second data storage circuit. The driving circuit is electrically coupled to the lighting element. The first data storage circuit is electrically coupled to the driving circuit. The first data storage circuit is configured to transmit a first data signal to the driving circuit during a first frame period, and the driving circuit is configured to drive the lighting element according to the first data signal. The second data storage circuit is electrically coupled in parallel with the first data storage circuit. The second data storage circuit is configured to transmit a second data signal to the driving circuit during a second frame period, and the driving circuit is configured to drive the lighting element according to the second data signal.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1:
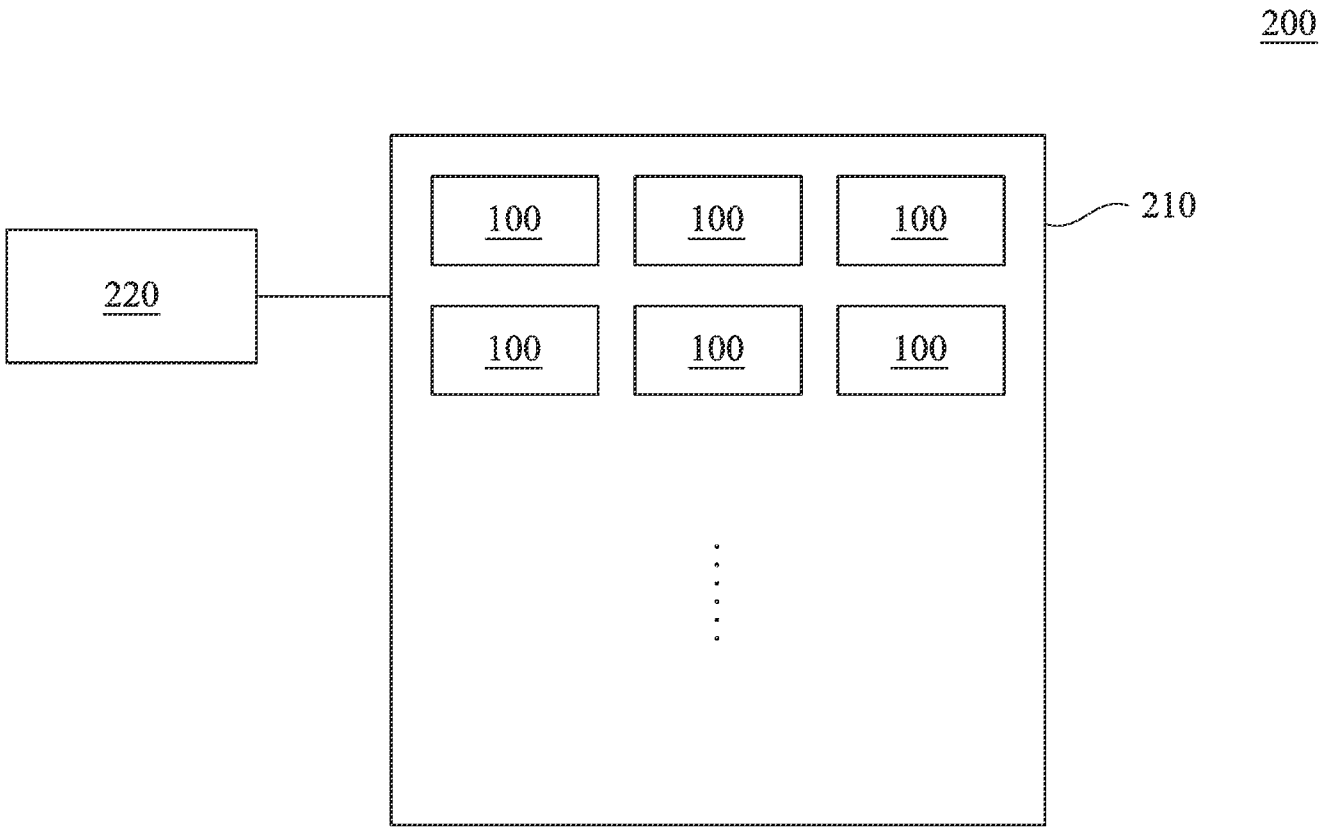
FIG. 1 is a schematic diagram of a display device in some embodiments of the present disclosure.

The present disclosure relates to a pixel circuit and a driving method. In one embodiment, the pixel circuit 100 is implemented to a display device 200. FIG. 1 is a schematic diagram of a display device in some embodiments of the present disclosure. The display device 200 includes a display panel 210 and a controller 220. The display panel 210 has multiple pixel circuits 100, each of pixel circuits 100 is configured to drive the lighting element inside (e.g., Light emitting diode, Organic light emitting diode), and display the brightness or color of a pixel in the image screen.

Figure 2A:
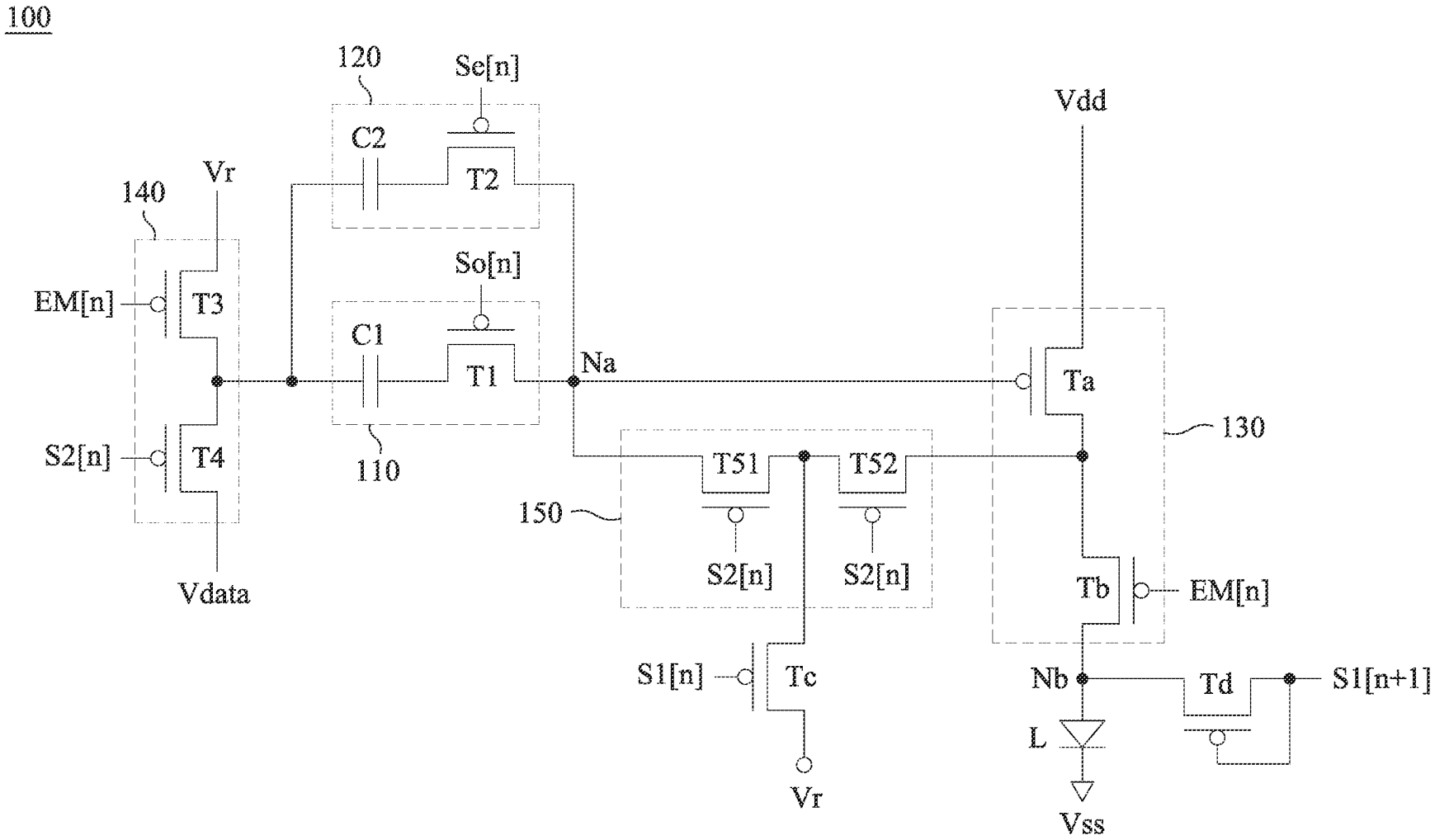
FIG. 2A is a schematic diagram of a pixel circuit in some embodiments of the present disclosure.
Figure 2B:
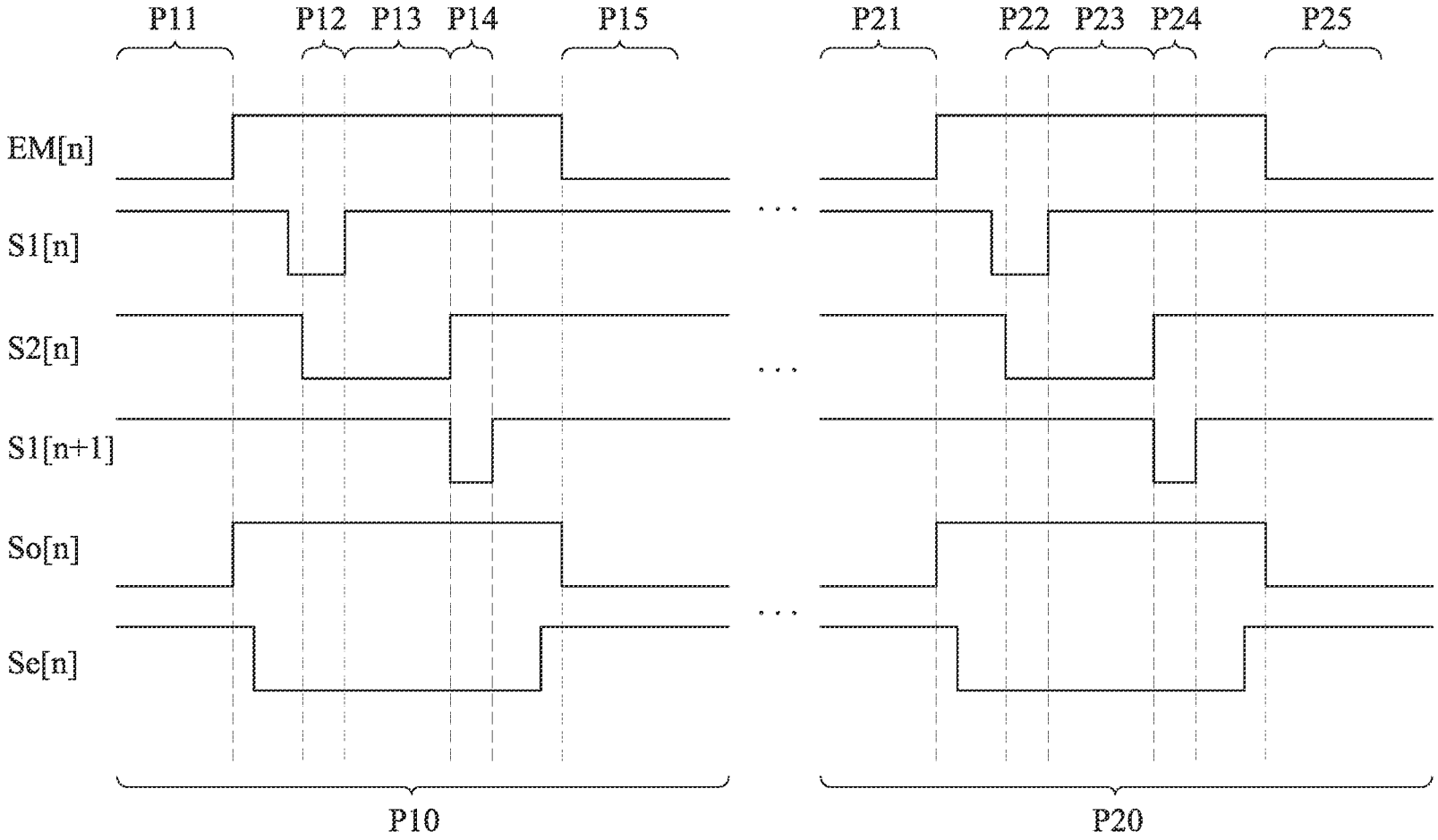
FIG. 2B is a waveform of the signal of the pixel circuit in some embodiments of the present disclosure.

FIG. 2A is a schematic diagram of a pixel circuit in some embodiments of the present disclosure. FIG. 2B is a waveform of the signal of the pixel circuit in some embodiments of the present disclosure. In one embodiment, the controller 220 is electrically coupled to the pixel circuit 100, and is configured to transmit multiple control signals EM, S1[*n*], S2[*n*], S1[*n*+1], So[n], Se[n] to the pixel circuit 100, wherein "n" represents the pixel circuit 100 used to control the n-th row in the display panel 210. The pixel circuit 100 performs different operations such as lighting, resetting, and data writing according to the control signals.

In one embodiment, the pixel circuit 100 includes a lighting element L, a first data storage circuit 110, a second data storage circuit 120 and a driving circuit 130. The lighting element L may be implemented by LED. The driving circuit 130 is electrically coupled to the lighting element L, and provides the driving current through a high voltage source Vdd and a low voltage source VSS to conduct the lighting element L, so that the lighting element emits light. In some embodiments, the driving circuit includes a driving transistor Ta and a switching transistor Tb. The gate terminal of the driving transistor Ta is coupled to the node Na of the driving circuit 130. The driving circuit 130 adjusts the driving current according to the voltage of the node Na (i.e., the gate voltage of the driving transistor Ta). The switching transistor Tb is turned on or turned off in response to the control signal EM[n].

The first data storage circuit 110, the second data storage circuit 120 is electrically coupled to the driving circuit 130, and is configured to alternately store the data signal Vdata in different frame periods. In one embodiment, the first data storage circuit 110 is configured to store the data signal corresponding to the frame period of the odd frame, the second data storage circuit 120 is configured to store the data signal corresponding to the frame period of the even frame. In addition, the data storage circuit 110, 120 receives the data signal in advance during previous frame period. In other words, before entering/starting the first frame period P10, the first data storage circuit 110 stores the first data signal in advance. Therefore, when entering the first frame period P10, the first data storage circuit 110 mat transmit the first data signal to the driving circuit 130, so that the driving circuit 130 the lighting element L according to the first data signal drives.

Similarly, during the first frame period P10, the second data storage circuit 120 receives and stores the second data signal in advance. During the second frame period P20, the second data storage circuit 110 may transmit the pre-stored second data signal to the driving circuit 130, so that the driving circuit 130 drives the lighting element L according to the second data signal. At the same time, the first data storage circuit 110 receives and stores the third data signal during the second frame period P20. During the third frame period, the third data signal is transmitted to the driving circuit 130, so that the driving circuit 130 drives the lighting element L according to the third data signal. In some embodiments, the first data storage circuit 110, the second data storage circuit 120 are electrically connected in parallel.

In some embodiments, the first data storage circuit 110 includes a first storage element C1 and a first switching element T1. The first storage element C1 (e.g., the capacitor) is configured to store the data signal corresponding to the frame period of the odd frame (e.g., the first data signal, the third data signal). The first switching element T1 is electrically coupled in series to the first storage element C1, and is turned on during the lighting time of the frame period of the odd frame (e.g., the first data signal, the third data signal), so that the first data signal stored by the first storage element C1 is transmitted to the driving circuit 130. As shown in FIG. 2A, in one embodiment, the first switching element T1 is electrically coupled between the node Na of the driving circuit 130 and the first storage element C1. Therefore, when the first switching element T1 is turned off, the signal stored in the first storage element C1 cannot be transmitted to the driving circuit 130.

Similarly, the second data storage circuit 120 includes a second storage element C2 and a second switching element T2. The second storage element C2 is configured to store the data signal corresponding to the frame period of the even frame (e.g., the second data signal). The second switching element T2 is electrically coupled in series to the second storage element C1, and is turned on during the lighting time of the frame period of the even frame (e.g., the second data signal), so that the second data signal stored by the second storage element C2 is transmitted to the driving circuit 130. As shown in FIG. 2A, in one embodiment, the second switching element T2 is electrically coupled between the node Na of the driving circuit 130 and the second storage element C2. Therefore, when the second switching element T2 is turned off, the signal stored in the second storage element C2 cannot be transmitted to the driving circuit 130.

In one embodiment, the first switching element T1, the second switching element T2, the driving transistor Ta, the switching transistor Tb are all implemented by PMOS. In other words, when the control signal Se[n], So[n], EM[n] or the gate terminal of transistors T1, T2, Ta, Tb receive a low level logic signal, the transistors T1, T2, Ta, Tb will be turned on. On the other hand, when the control signal Se[n], So[n], EM[n] or the gate terminal of transistors T1, T2, Ta, Tb receive the high level logic signal, the transistors T1, T2, Ta, Tb will be turned off. In some other embodiments, the transistors T1, T2, Ta, Tb may be implemented by NMOS or other types of switching elements.

In one embodiment, all of the pixel circuits 100 on the display panel 210 receive the data signal in advance during the previous frame period (e.g., the first frame period), and when entering to the next frame period (e.g., the second frame period), drive the lighting element L at the same time. Accordingly, all the lighting elements L will be ensured to light up at the same time, so that the display panel 210 will complete the screen update. Therefore, it will be avoided that the update time of each pixel circuit 100 on the display panel 210 is different, which may cause image errors.

As shown in FIG. 2B, in one embodiment, each frame period includes a lighting time, a reset time and a writing time. The pixel circuit 100 drives the lighting element L according to the pre-stored data signal during the lighting time (e.g., the first lighting time P11, the second lighting time P15), resets the voltage of the lighting element L or the storage element during the reset time, and receive the data signal of the next frame period during the writing time.

In some embodiments, each frame period enters the first lighting time P11, P21, and then enters the writing time to ensure that at the beginning of each frame period, all of the lighting elements L can display the corresponding brightness or color at the same time.

In some embodiments, the pixel circuit 100 further includes a writing circuit 140 and a compensation circuit 150. The writing circuit 140 is electrically coupled to the first data storage circuit 110 and the second data storage circuit 120, and is configured to transmit the data signal to the corresponding data storage circuit during the writing time P13. The compensation circuit 150 is electrically coupled to the driving circuit 130, the first data storage circuit 110 and the second data storage circuit 120, and is configured to write the compensation signal to the node Na (the gate terminal of the driving transistor Ta) during the writing time P13. In some embodiments, the compensation circuit 150 is electrically coupled between the gate terminal and the source terminal of the driving transistor Ta in the driving circuit 130, or is electrically coupled between the source terminal of the driving transistor Ta and the data storage circuits 110, 120.

The following describes how the first data storage circuit 110 and the second data storage circuit 120 operate in different periods. During the first lighting time P11 and the second lighting time P15 of the first frame period P10, the first switching element T1 is turned on, the second switching element T2 is turned off, so that the data signal stored in the first storage element C1 is transmitted to the driving circuit 130. Similarly, during the second lighting time P21 and the second lighting time P25 of the second frame period P20, the first switching element T1 is turned off, the second switching element T2 is turned on, so that the data signal stored in the second storage element C2 is transmitted to the driving circuit 130.

In one embodiment, as shown in FIG. 2A and FIG. 2B, each frame period includes a first reset time P12 and a second reset time P14. During the first reset time P12, the voltage of the storage elements C1, C2 may be reset. During the second reset time P14, the voltage of the lighting element L may be reset. For example, during the first reset time P12 of the first frame period P10, the reset switch Tc of the pixel circuit 100 is turned on, so that the second storage element C2 conducts to the reference voltage Vr (e.g., ground) through the second switching element T2 and the reset switch Tc, so as to reset the stored data signal.

As mentioned above, during the second reset time P12 of the first frame period P10, the switching transistor Tb of the driving circuit 130 is turned off, the transistor switch Td is turned on, so that the voltage of the node Nb may discharge through the transistor switch Td, to avoid the problem of light leakage caused by undesired current passing through the lighting element L.

In addition, during the first reset time P12 and the second reset time P14 of the first frame period P10, the first switching element T1 is turned off, the second switching element T2 is turned on, so that the pre-stored data signal of the first storage element C1 will not be affected. Similarly, during the first reset time P22 and the second reset time P24 of the second frame period P20, the first switching element T1 is turned on, the second switching element T2 is turned off, so that the pre-stored data signal of the second storage element C2 will not be affected.

In one embodiment, the writing time is configured to receive the data signal, and is configured to compensate the driving circuit 130 at the same time. For example, during the writing time P13 of the first frame period P10, the first switching element T1 is turned off, the second switching element T2 is turned on, the compensation circuit 150 is turned on, so that the second storage element C2 receive the second data signal from the writing circuit 140. At the same time, the high voltage source Vdd writes the compensation signal to the node Na through the driving transistor Ta and the compensation circuit 150. Since the first switching element T1 is turned off, the first data signal stored in the first storage element C1 will not be affected.

Similarly, during the writing time P23 of the second frame period P20, the first switching element T1 is turned on, the second switching element T2 is turned off, the compensation circuit 150 is turned on, so that the first storage element C1 receives the third data signal from the writing circuit 140. At the same time, the high voltage source Vdd writes the compensation signal to the node Na through the driving transistor Ta and the compensation circuit 150. Since second switching element T2 is turned off, the second data signal stored in the second storage element C2 will not be affected.

In some embodiments, the writing circuit 140 includes a third switching element T3 and a fourth switching element T4. The third switching element T3 is electrically coupled to the reference voltage Vr (e.g., ground), the fourth switching element T4 is electrically coupled to the controller 220, and is configured to receive the correspond data signal.

Figure 3:
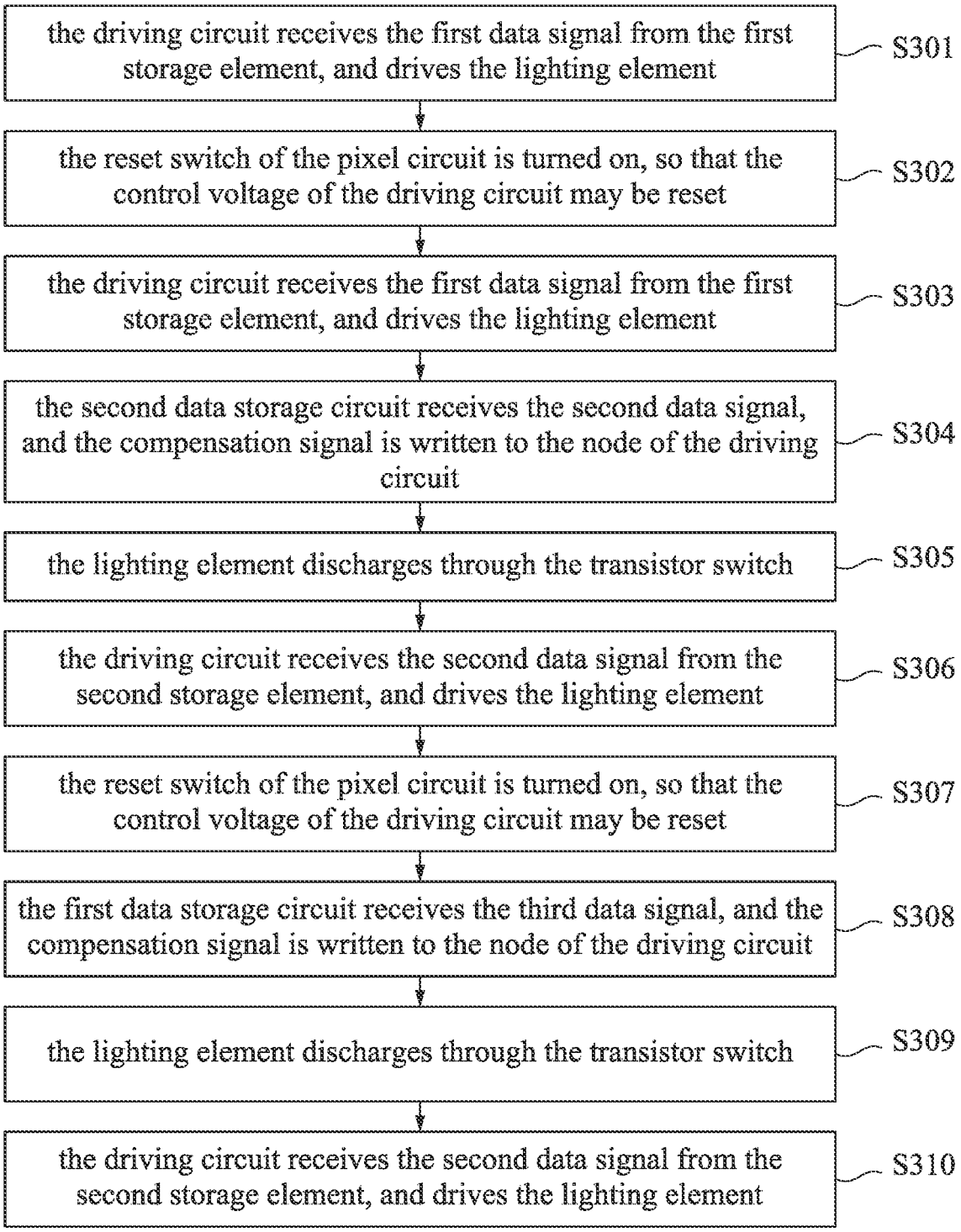
FIG. 3 is a flowchart illustrating a pixel circuit driving method in some embodiments of the present disclosure.
Figure 4A:
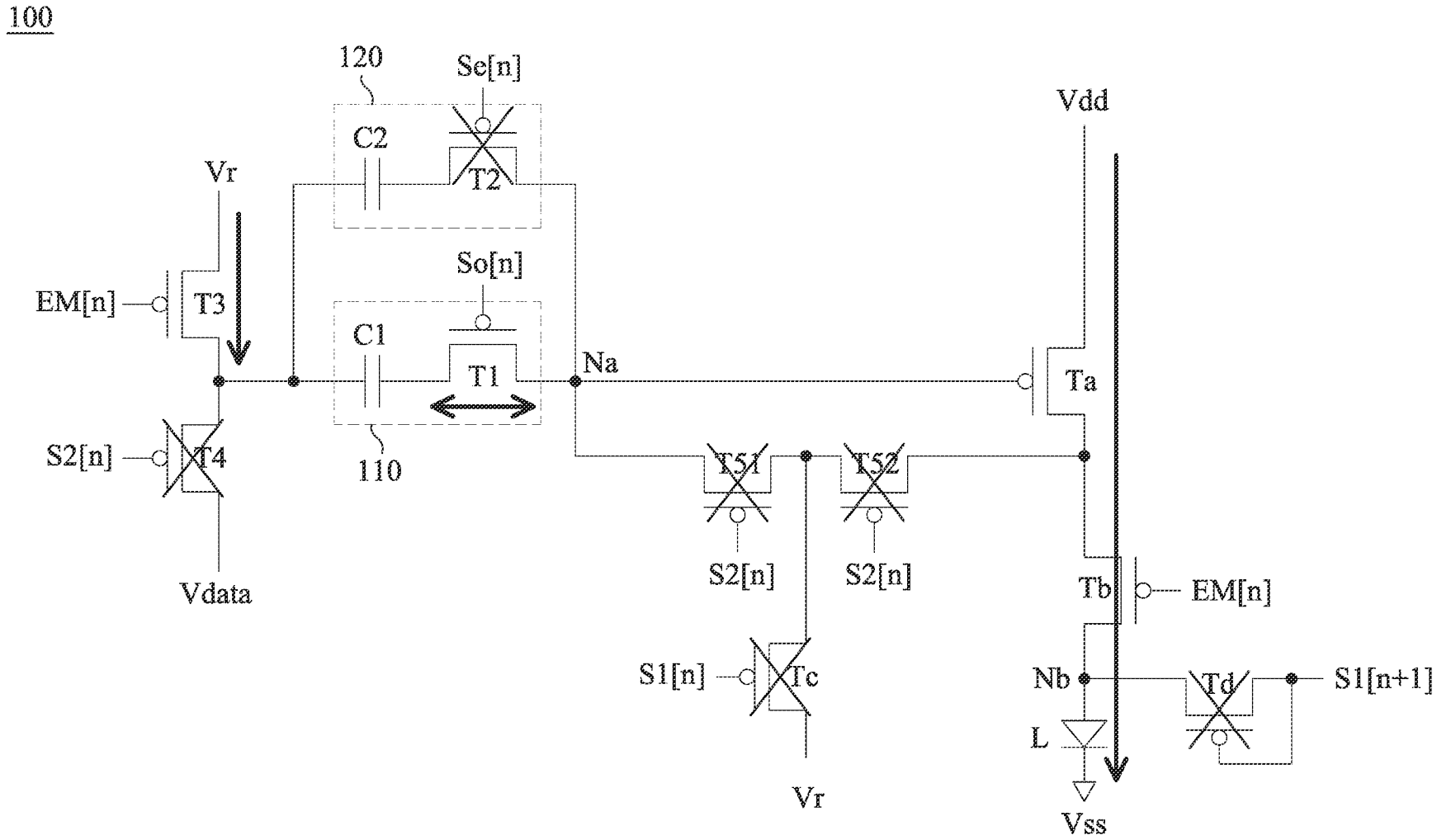
FIGS. 4A-4E are schematic diagrams of the pixel circuit during the first frame period in some embodiments of the present disclosure.

In order to understand the operation of the pixel circuit 100, the driving method of the pixel circuit 100 is explained below. FIG. 3 is a flowchart illustrating a pixel circuit driving method in some embodiments of the present disclosure. FIG. 4A-4E are schematic diagrams of the pixel circuit during the first frame period in some embodiments of the present disclosure. As shown in FIG. 4A, in step S301, during the first lighting time P11 of the first frame period P10, the first storage element C1 has the first data signal stored in the previous frame period. At this time, the first switching element T1 is turned on, the second switching element T2 is turned off, the driving transistor Ta and the switching transistor Tb is turned on, the transistor switch Td is turned off. The third switching element T3 of the writing circuit 140 is turned on, the fourth switching element T4 is turned off. The compensation circuit 150 is turned off. The driving circuit 130 receives the first data signal from the first storage element C1, and drives the lighting element L according to the first data signal.

Figure 4B:
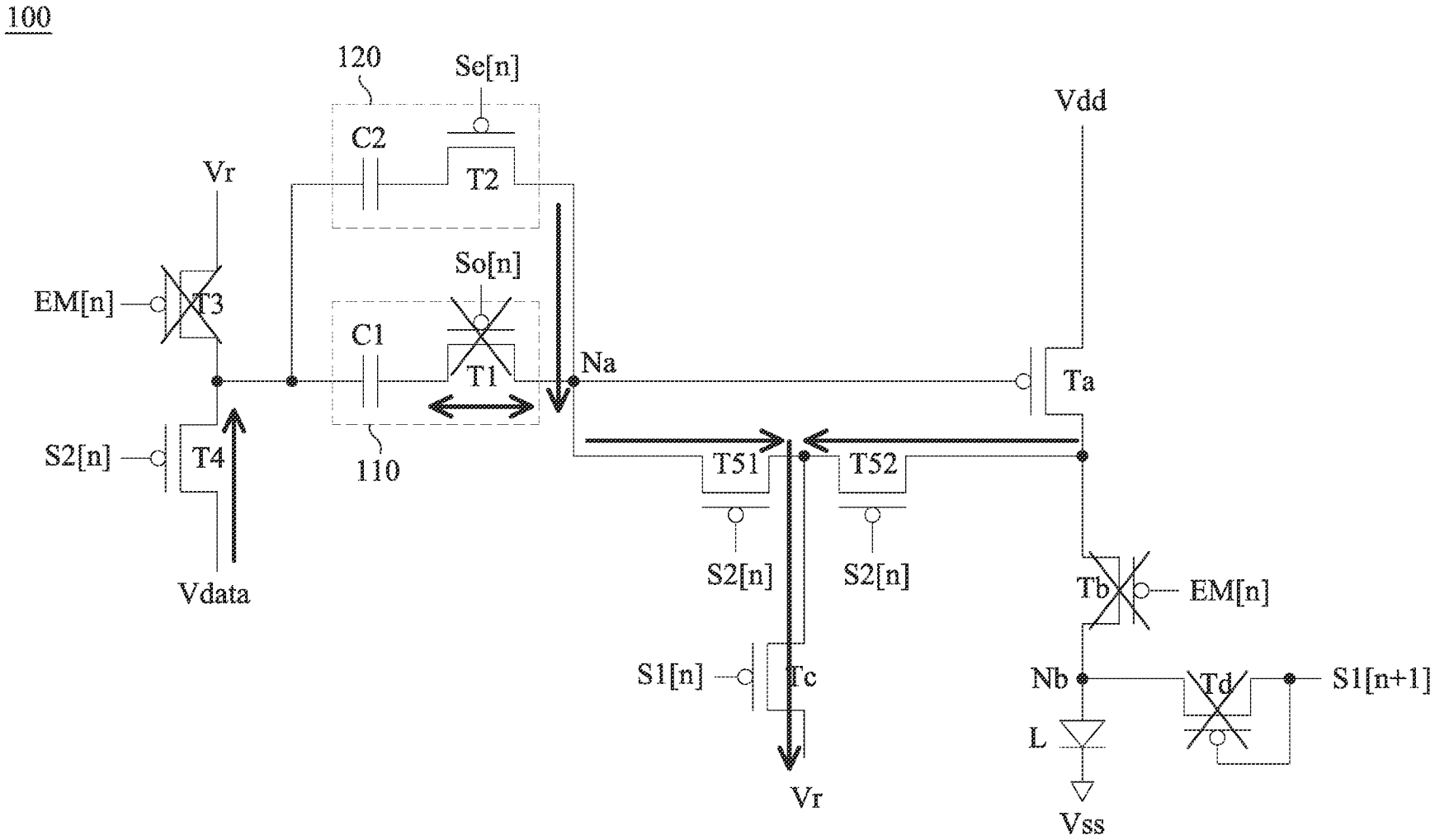

As shown in FIG. 4B, in step S302, during the first reset time P12 of the first frame period P10, the first switching element T1 is turned off, the second switching element T2 is turned on, the switching transistor Tb is turned off. The third switching element T3 of the writing circuit 140 is turned off, the fourth switching element T4 is turned on, the compensation circuit 150 is turned on. At this time, the reset switch Tc of the pixel circuit 100 is turned on, the reset switch Tc is electrically coupled to the node Na through the compensation circuit 150, so that the control voltage (i.e., the voltage of the node Na) of the driving circuit 130 may be conduct to the reference voltage Vr to reset (e.g., become zero) by the compensation circuit 150 and the reset switch Tc is.

Figure 4C:
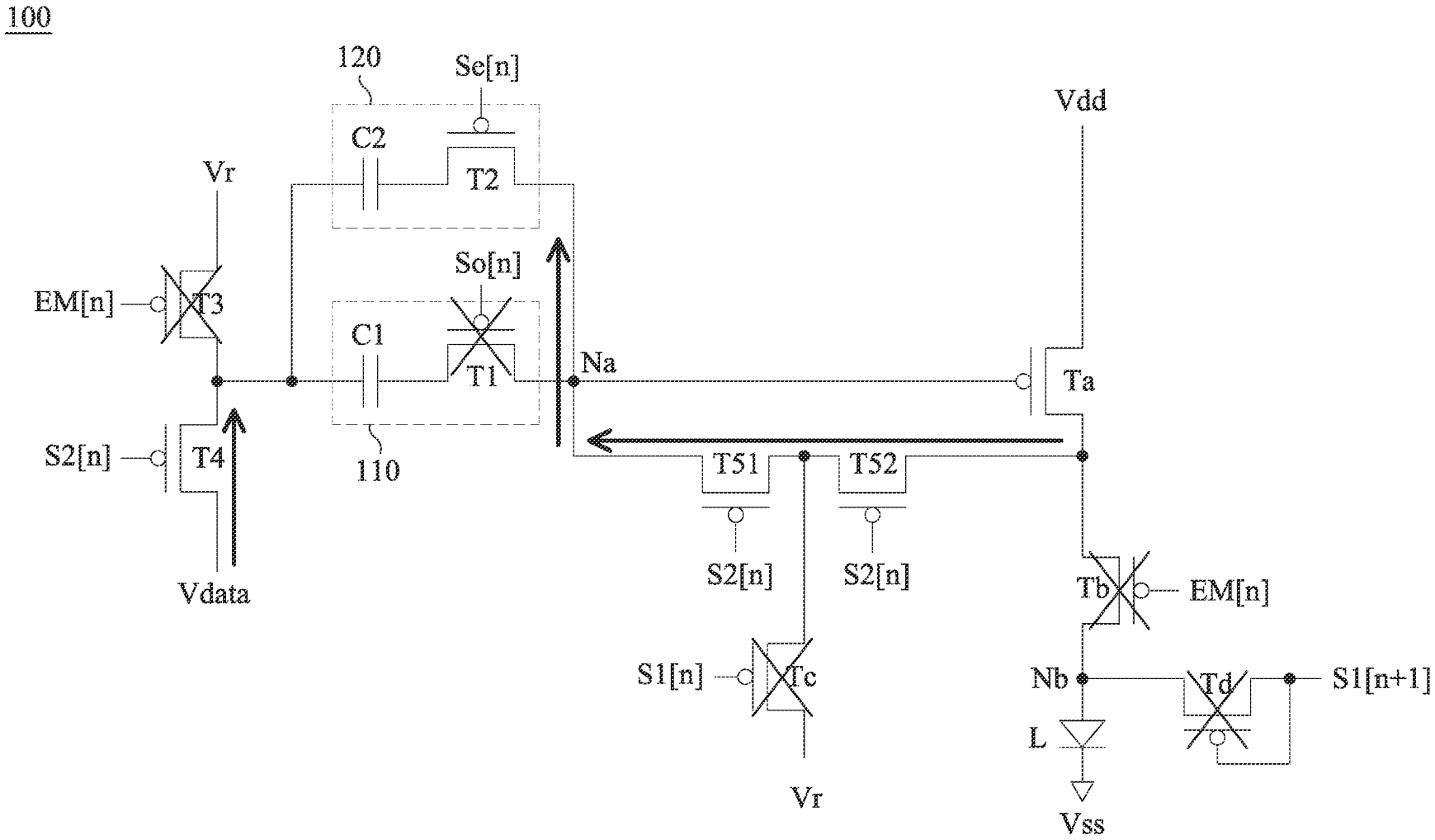

As shown in FIG. 4C, in step S303, during the writing time P13 of the first frame period P10, the first switching element T1 is turned off, the second switching element T2 is turned on, the driving transistor Ta is turned on, the switching transistor Tb is turned off, the transistor switch Td is turned off. The third switching element T3 of the writing circuit 140 is turned off, the fourth switching element T4 is turned on. The compensation circuit 150 is turned on, the reset switch Tc is turned off. At this time, the second storage element C2 receives and stores the second data signal through the writing circuit 140. At the same time, the high voltage source Vdd, the driving transistor Ta, the compensation circuit 150 and the second data storage circuit 120 may form a circuit loop, so as to transmit (write) the compensation signal (i.e., Vdd-Vth, Vth is the threshold voltage of the driving transistor Ta) to the node Na of the driving circuit 130.

Figure 4D:
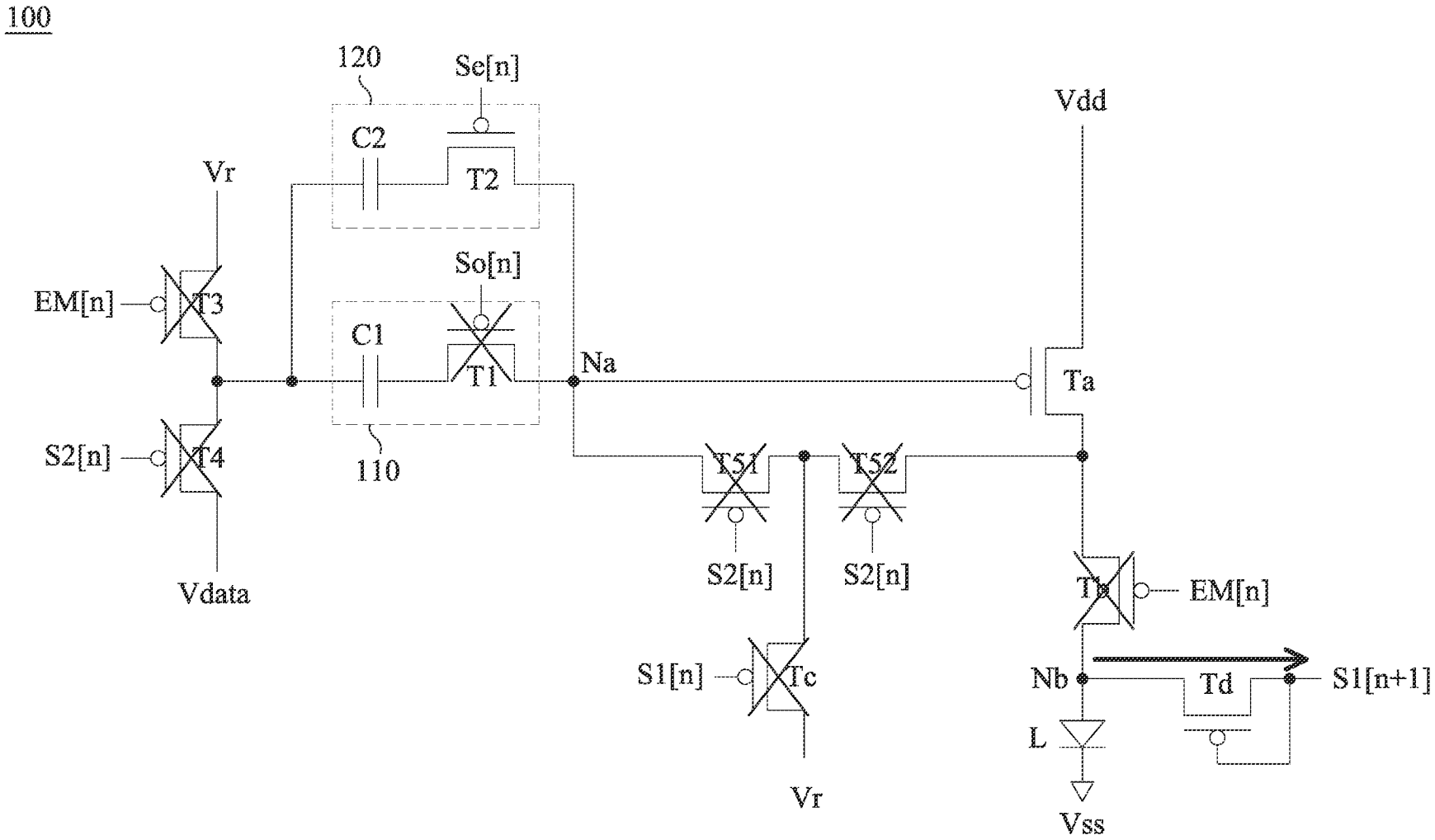

As shown in FIG. 4D, in step S304, during the second reset time P14 of the first frame period P10, the first switching element T1 is turned off, the second switching element T2 is turned on, the writing circuit 140 is turned off, the switching transistor Tb is turned off, the transistor switch Td is turned on. At this time, the lighting element L (or voltage of the node Nb) discharges through the transistor switch Td to avoid the problem of light leakage caused by undesired current passing through the lighting element L.

Figure 4E:
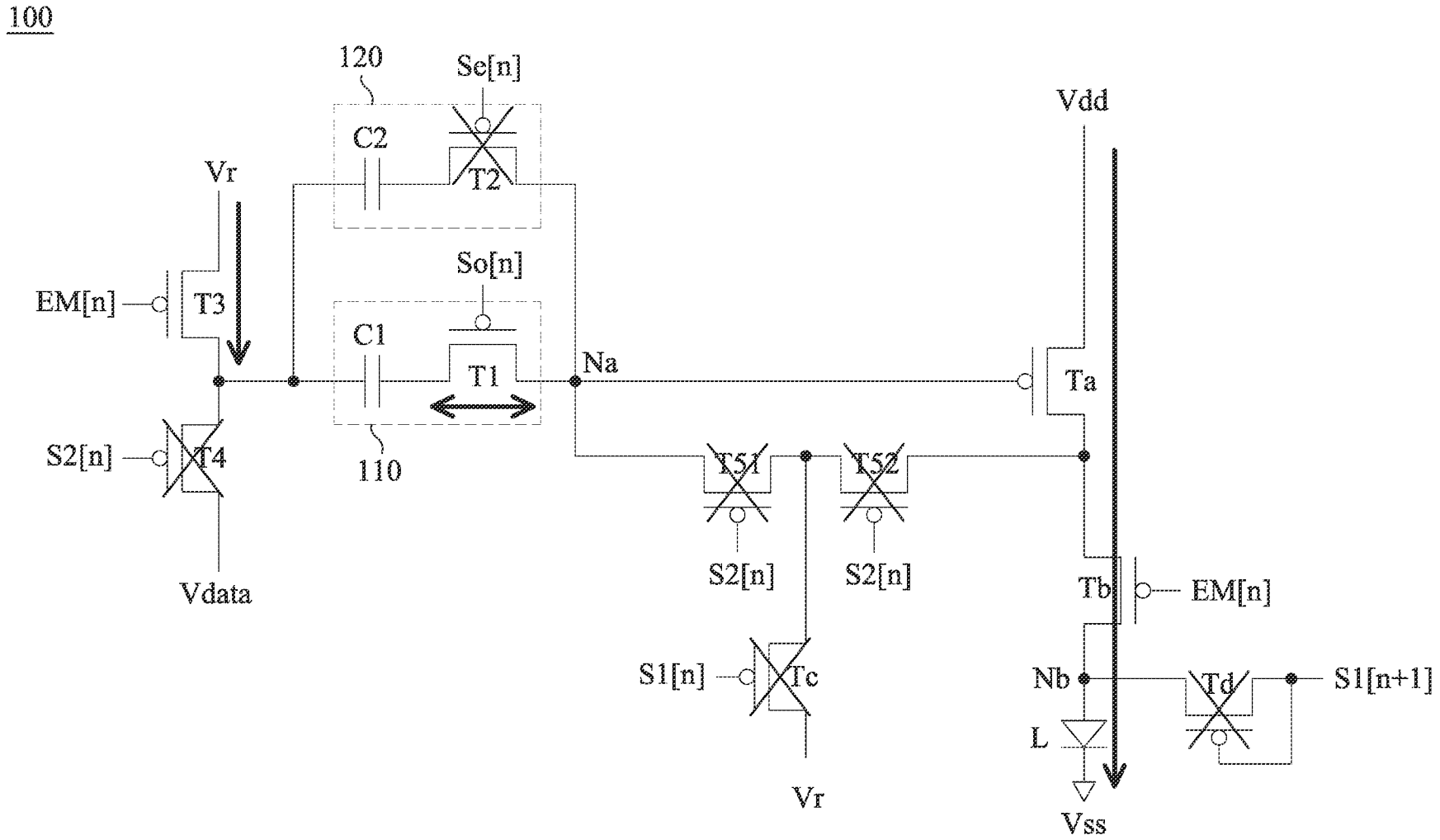

During the first reset time P12, the writing time P13 and the second reset time P14, since the first switching element T1 is maintain to be turned off, the first data signal stored in the first storage element C1 will not change by the voltage change of the node Na. Accordingly, after the second reset time P14, the pixel circuit 100 may light again. As shown in FIG. 4E, in step S305, during the second lighting time P15 of the first frame period P10, the first switching element T1 is turned on, the second switching element T2 is turned off, the driving transistor Ta and the switching transistor Tb is turned on, the transistor switch Td is turned off. The third switching element T3 of the writing circuit 140 is turned on, the fourth switching element T4 is turned off. The driving circuit 130 receives the first data signal from the first storage element C1, and drives the lighting element L according to the first data signal.

Figure 5A:
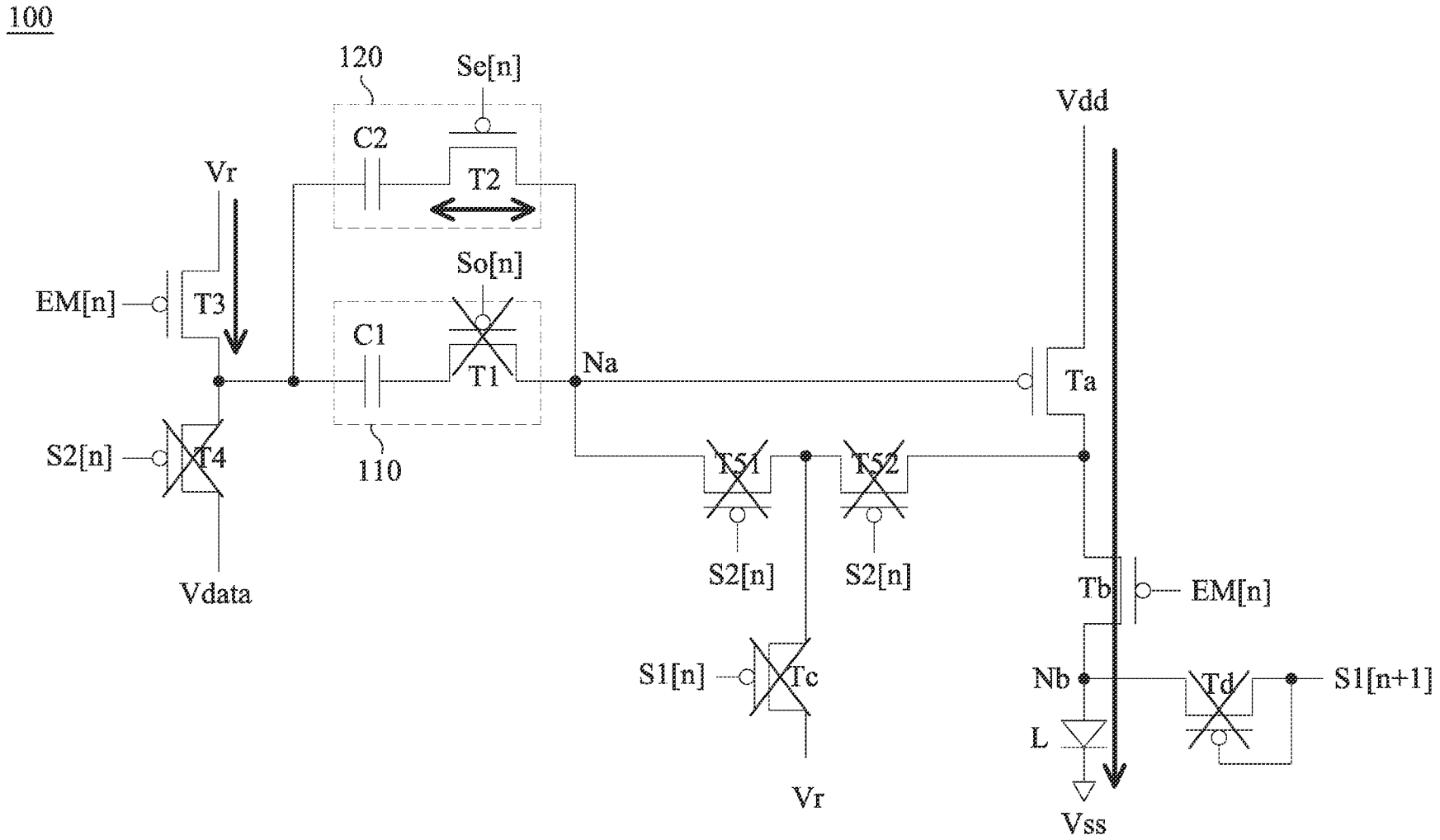
FIGS. 5A-5E are schematic diagrams of the pixel circuit during the first frame period in some embodiments of the present disclosure.

During the second frame period P20, the operation of the pixel circuit 100 is same as the operation of the first frame period P10. At this time, the pixel circuit 100 drives the lighting element L through the second data storage circuit 120, and writes the third data signal to the first data storage circuit. FIG. 5A-5E are schematic diagrams of the pixel circuit during the first frame period in some embodiments of the present disclosure. As shown in FIG. 5A, in step S306, during the first lighting time P21 of the second frame period P20, the second storage element C2 has the second data signal stored in the first frame period in advance. At the same time, the first switching element T1 is turned off, the second switching element T2 is turned on, the driving transistor Ta and the switching transistor Tb is turned on, the transistor switch Td is turned off. The third switching element T3 of the writing circuit 140 is turned on, the fourth switching element T4 is turned off. The compensation circuit 150 is turned off. The driving circuit 130 receives the second data signal from the second storage element C2, and drives the lighting element L according to the second data signal.

Figure 5B:
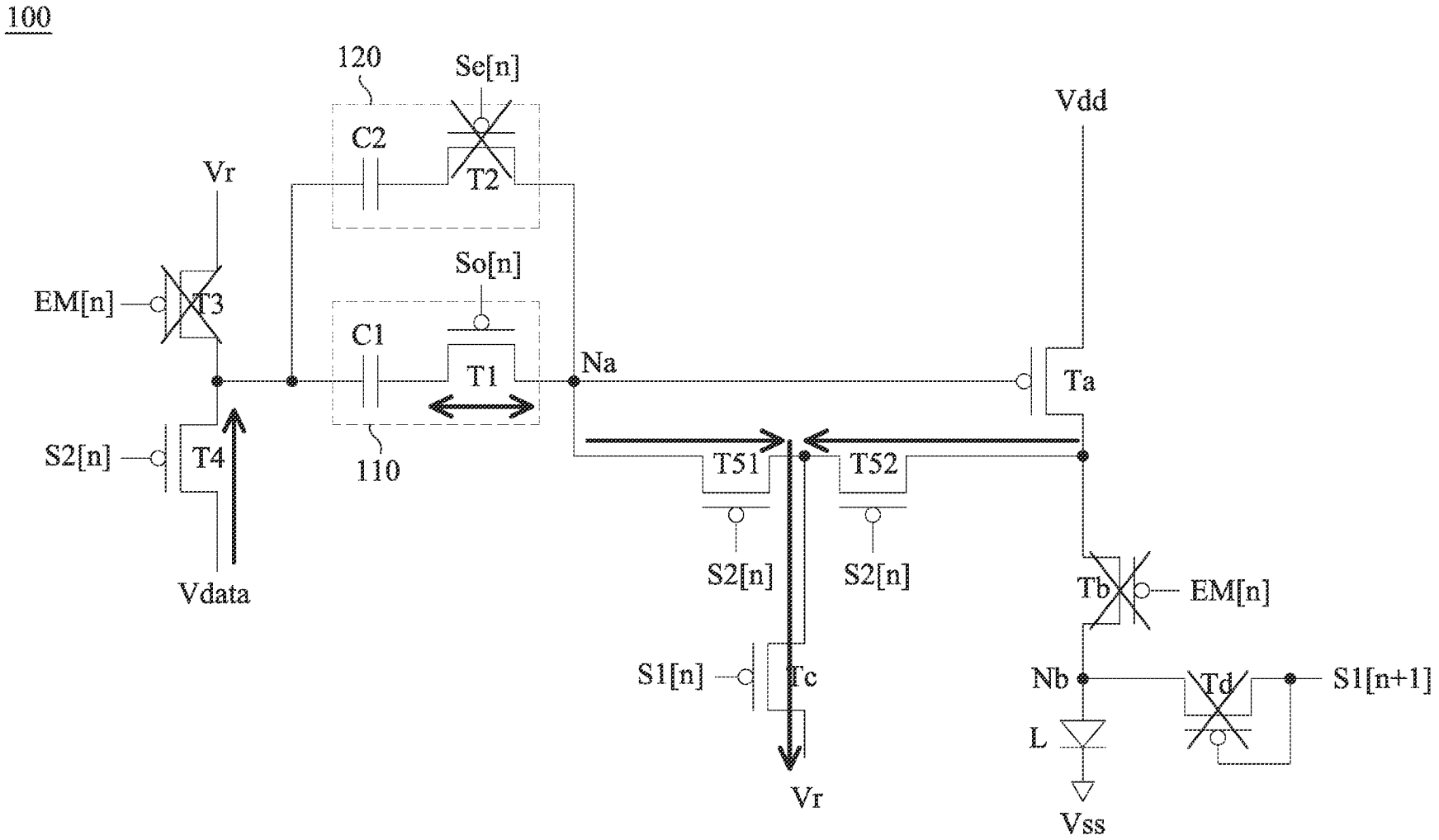

As shown in FIG. 5B, in step S307, during the first reset time P22 of the second frame period P20, the first switching element T1 is turned on, the second switching element T2 is turned off, the switching transistor Tb is turned off. The third switching element T3 is turned off, the fourth switching element T4 is turned on, the compensation circuit 150 is turned on. At the same time, the reset switch Tc of the pixel circuit 100 is turned on, the reset switch Tc is electrically coupled to the node Na through the compensation circuit 150, so that the control voltage (i.e., voltage of the node Na) of the driving circuit 130 conducts to the reference voltage Vr to reset (e.g., become zero) through the compensation circuit 150 and the reset switch Tc.

Figure 5C:
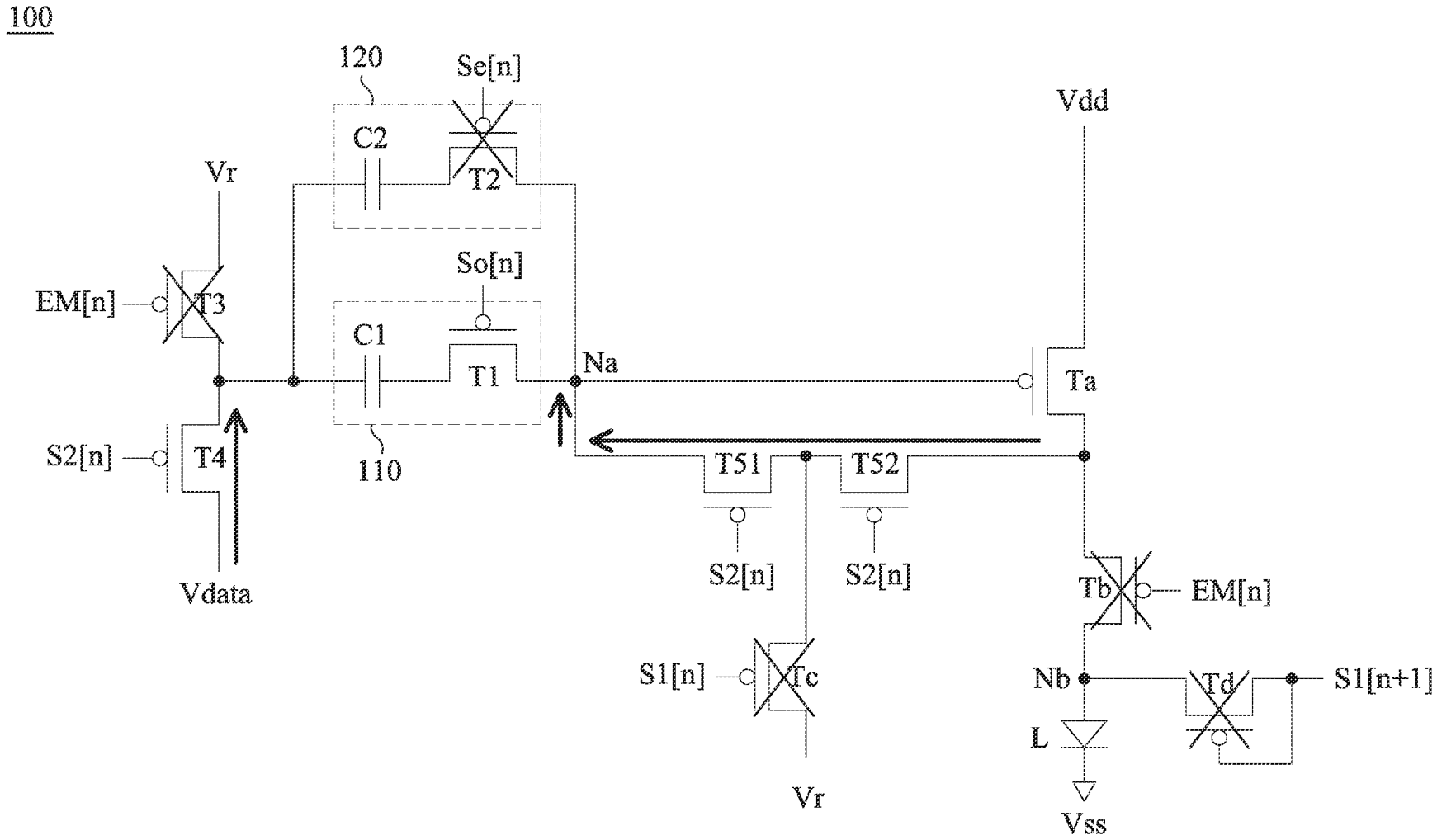

As shown in FIG. 5C, in step S308, during the writing time P23 of the second frame period P20, the first switching element T1 is turned on, the second switching element T2 is turned off, the driving transistor Ta is turned on, the switching transistor Tb is turned off, the transistor switch Td is turned off. The third switching element T3 of the writing circuit 140 is turned off, the fourth switching element T4 is turned on. The compensation circuit 150 is turned on, the reset switch Tc is turned off. At this time, the first storage element C1 receives and stores the third data signal though the writing circuit 140. At the same time, the high voltage source Vdd, the driving transistor Ta, the compensation circuit 150 and the first data storage circuit 110 may form a circuit loop, so that the compensation signal (i.e., Vdd-Vth, Vth is the threshold voltage of the driving transistor Ta) may be transmitted (written) to the node Na of the driving circuit 130.

Figure 5D:
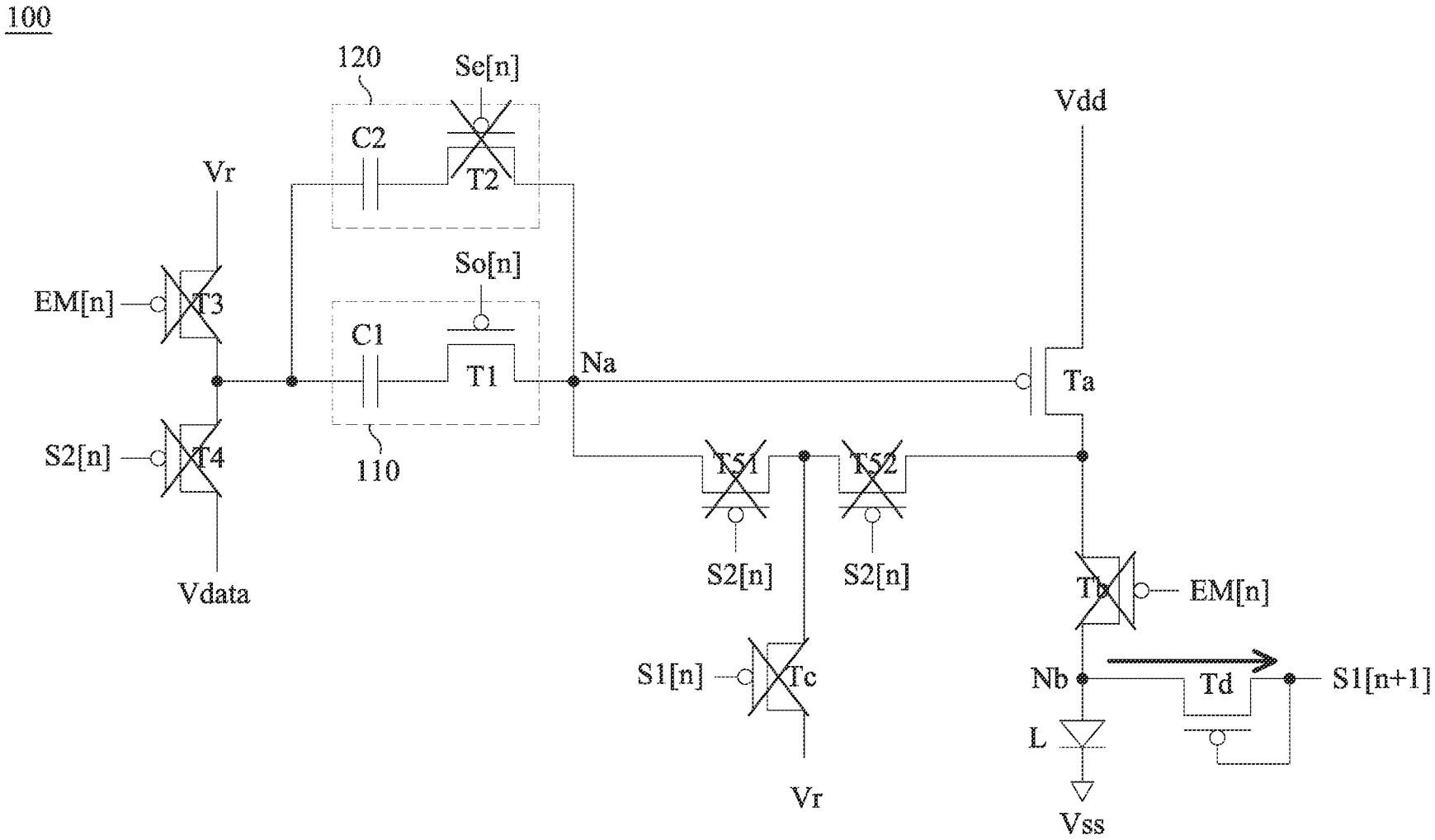

As shown in FIG. 5D, in step S309, during the second reset time P24 of the second frame period P20, the first switching element T1 is turned on, the second switching element T2 is turned off, the writing circuit 140 is turned off, the switching transistor Tb is turned off, the transistor switch Td is turned on. At this time, the lighting element L (or voltage of the node Nb) discharges through the transistor switch Td to avoid the problem of light leakage caused by undesired current passing through the lighting element L.

Figure 5E:
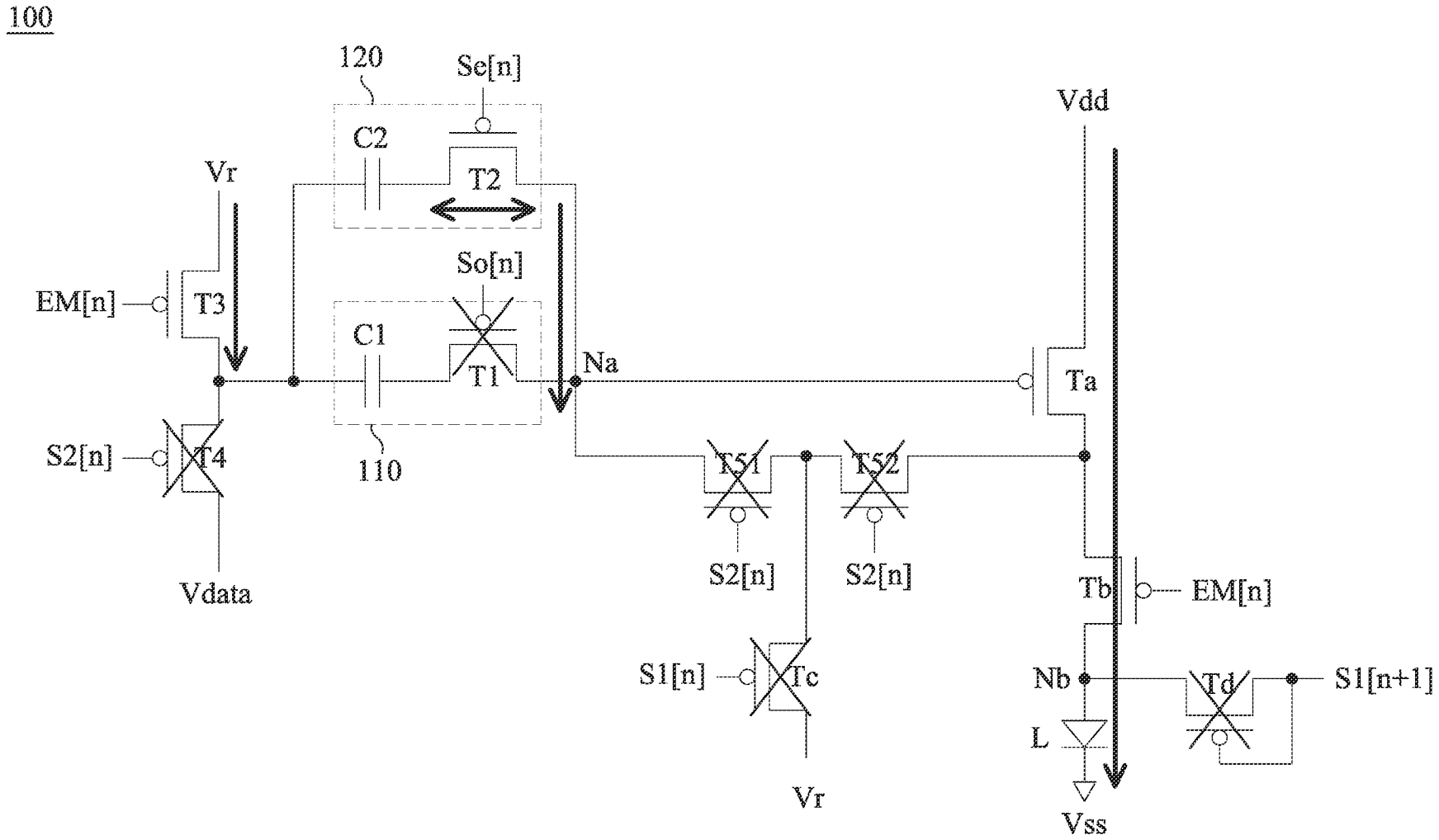

During the first reset time P22, the writing time P23 and the second reset time P24, since the second switching element T2 is maintained to be turned off, the second data signal stored in the second storage element C2 will not be affected by the voltage change of the node Na. As shown in FIG. 5E, in step S310, during the second lighting time P25 of the second frame period P20, the first switching element T1 is turned off, the second switching element T2 is turned on, the driving transistor Ta and the switching transistor Tb is turned on, the transistor switch Td is turned off. The third switching element T3 of the writing circuit 140 is turned on, the fourth switching element T4 is turned off. The driving circuit 130 receives the second data signal from the second storage element C2, and drives the lighting element L according to the second data signal.

As shown in FIG. 2A, in one embodiment, the compensation circuit 150 includes at least one compensation transistor (in the embodiment of FIG. 2A, it includes two the compensation switches T51, T52). The compensation switches T51, T52 are electrically coupled to the source terminal and the gate terminal (the node Na) of driving transistor Ta, respectively. The reset switch Tc is electrically coupled between the compensation switches T51, T52. During the writing time (e.g., the writing time P13, P23) of each frame period, the compensation switch T51, T52 may be turned on, so as to transmit the compensation signal to the gate terminal of the driving transistor Ta through the compensation switch T51, T52.

In addition, n the embodiment in FIG. 2A, the reset switch Tc is electrically coupled between the compensation switches T51, T52. In other embodiments, the reset switch Tc may be directly couple to the node Na. During the first reset time (i.e., P12, P22), the reset switch Tc is turned on, so that the signal of the corresponding storage element (i.e., C1 or C2) may be reset through the corresponding switching element (i.e., T1 or T2) and the reset switch Tc.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A pixel circuit, comprising:

a lighting element;

a driving circuit electrically coupled to the lighting element;

a first data storage circuit electrically coupled to the driving circuit, wherein the first data storage circuit is configured to transmit a first data signal to the driving circuit during a first frame period, and the driving circuit is configured to drive the lighting element according to the first data signal; and a second data storage circuit electrically coupled to the driving circuit, wherein the second data storage circuit is configured to receive a second data signal during the first frame period;

wherein the first data storage circuit is configured to receive a third data signal during a second frame period, the second data storage circuit is configured to transmit the second data signal to the driving circuit, and the driving circuit is configured to drive the lighting element according to the second data signal.

2. The pixel circuit of claim 1, wherein the first data storage circuit comprises:

a first storage element configured to store the first data signal; and a first switching element electrically coupled to the first storage element, wherein the first switching element is turned on during the first frame period, and the first data signal stored by the first storage element is transmitted to the driving circuit.

3. The pixel circuit of claim 2, wherein the second data storage circuit comprises:

a second storage element configured to store the second data signal; and a second switching element electrically coupled to the second storage element, wherein the second switching element is turned on during the second frame period, and the second data signal stored by the second storage element is transmitted to the driving circuit.

4. The pixel circuit of claim 3, wherein the first switching element is turned on and the second switching element is turned off during a lighting time of the first frame period, and the first switching element is turned off and the second switching element is turned on during a writing time of the first frame period.

5. The pixel circuit of claim 3, wherein the second switching element is turned on during a writing time of the first frame period to receive the second data signal, and the driving circuit receives a compensation signal by a compensation circuit and the second data storage circuit.

6. The pixel circuit of claim 1, further comprising:

a compensation circuit electrically coupled to the driving circuit, the first data storage circuit and the second data storage circuit, wherein a compensation switch of the compensation circuit is turned on to transmit a compensation signal to the driving circuit during a writing time of the first frame period.

7. A pixel circuit driving method, comprising:

receiving a first data signal from a first data storage circuit during a first frame period, and driving a lighting element according to the first data signal, wherein driving the lighting element according to the first data signal comprising:

turning a first switching element electrically coupled in series to the first data storage circuit during a lighting time of the first frame period to transmit the first data signal to a driving circuit, wherein the driving circuit is electrically coupled to the lighting element;

receiving and storing a second data signal by a second data storage circuit during the first frame period;

receiving the second data signal from the second data storage circuit during a second frame period, and driving the lighting element according to the second data signal; and receiving and storing a third data signal by a first data storage circuit during the second frame period.

8. The pixel circuit driving method of claim 7, wherein driving the lighting element according to the first data signal comprising:

turning off a second switching element electrically coupled in series to the second data storage circuit during the lighting time of the first frame period.

9. The pixel circuit driving method of claim 8, wherein receiving and storing the second data signal by the second data storage circuit comprising:

turning on the second switching element during a writing time of the first frame period.

10. The pixel circuit driving method of claim 9, wherein the lighting time is before the writing time.

11. The pixel circuit driving method of claim 9, further comprising:

turning off the first switching element during the writing time of the first frame period.

12. The pixel circuit driving method of claim 11, further comprising:

turning a compensation circuit and the second switching element during the writing time of the first frame period, and the driving circuit receiving a compensation signal by the compensation circuit and the second switching element, wherein the compensation circuit is electrically coupled between the driving circuit and the second data storage circuit.

13. A pixel circuit, comprising:

a lighting element;

a driving circuit electrically coupled to the lighting element;

a first data storage circuit electrically coupled to the driving circuit, wherein the first data storage circuit is configured to transmit a first data signal to the driving circuit during a first frame period, and the driving circuit is configured to drive the lighting element according to the first data signal; and a second data storage circuit electrically coupled in parallel with the first data storage circuit, wherein the second data storage circuit is configured to transmit a second data signal to the driving circuit during a second frame period, and the driving circuit is configured to drive the lighting element according to the second data signal;

wherein the second data storage circuit is configured to receive the second data signal during the first frame period, the first data storage circuit is configured to receive a third data signal during the second frame period, the first data storage circuit is configured to transmit the third data signal to the driving circuit during a third frame period, and the driving circuit is configured to drive the lighting element according to the third data signal.

14. The pixel circuit of claim 13, wherein the first data storage circuit comprises:

a first storage element configured to store the first data signal; and a first switching element electrically coupled to the first storage element, wherein the first switching element is turned on during the first frame period, and the first data signal stored by the first storage element is transmitted to the driving circuit.

15. The pixel circuit of claim 14, wherein the second data storage circuit comprises:

a second storage element configured to store the second data signal; and a second switching element electrically coupled to the second storage element, wherein the second switching element is turned on during the second frame period, and the second data signal stored by the second storage element is transmitted to the driving circuit.

16. The pixel circuit of claim 15, wherein the first switching element is turned on and the second switching element is turned off during a lighting time of the first frame period, and the first switching element is turned off and the second switching element is turned on during a writing time of the first frame period.

17. The pixel circuit of claim 15, wherein the second switching element is turned on during a writing time of the first frame period to receive the second data signal, and the driving circuit receives a compensation signal by a compensation circuit and the second data storage circuit.

* * * * *